US006895907B2

(12) United States Patent
Drew

(10) Patent No.: US 6,895,907 B2
(45) Date of Patent: May 24, 2005

(54) DIESEL ENGINE

(76) Inventor: Julius Drew, 3310 Cotton Mill Dr., Apt. 301, Raleigh, NC (US) 27612

( * ) Notice: Subject to any disclaimer, the term of this patent is extended or adjusted under 35 U.S.C. 154(b) by 0 days.

(21) Appl. No.: 10/682,098

(22) Filed: Oct. 10, 2003

(65) Prior Publication Data

US 2005/0076879 A1 Apr. 14, 2005

(51) Int. Cl.[7] ..... F02B 75/18
(52) U.S. Cl. ..... 123/56.1; 123/45 A
(58) Field of Search ..... 123/56.1, 56.3, 123/45 R, 45 A, 57.1, 58.5, 58.6

(56) References Cited

U.S. PATENT DOCUMENTS 4,069,794 A * 1/1978 Jordan ..... 123/25 A
4,070,999 A * 1/1978 Matsuno ..... 123/260
6,449,940 B2 * 9/2002 Nagel ..... 60/39.63
6,481,393 B1 * 11/2002 Drew ..... 123/56.1

* cited by examiner

*Primary Examiner*—John T. Kwon
(74) *Attorney, Agent, or Firm*—Jack Schuman

(57) ABSTRACT

In diesel engine, blower forces air into bore of cylinder head against small diameter piston of compound piston assembly forcing assembly down in engine cylinder, permitting air to enter combustion chamber. Diesel fuel injector introduces diesel fuel into combustion chamber where it mixes with injected air. Momentum of system forces compound piston assembly to the top of its stroke, compressing the air/diesel fuel mixture to the ignition point.

5 Claims, 4 Drawing Sheets

DIESEL ENGINE

BACKGROUND OF THE INVENTION

1. Field of the Invention

This invention relates, broadly speaking, to a novel diesel engine.

2. Description of the Prior Art

No prior art showing diesel engines related to the present invention is known to the inventor.

However, internal combustion engines bearing a superficial resemblance to the structure of the present invention, are known. For example, see U.S. Pat. No. 6,481,393 issued Nov. 19, 2002.

SUMMARY OF THE PRESENT INVENTION

One of the objects of the present invention is to provide a novel diesel engine.

Still other and further objects of the present invention will become apparent by reference to the accompanying specification and drawings, and to the appended claims.

Briefly, the foregoing objects are attained by providing a diesel engine having a unique structure in which air is injected through one end of the engine cylinder and diesel fuel is injected, at an appropriate stage of operation into the combustion cylinder.

DESCRIPTION OF THE DRAWINGS

Referring now to the drawings, in which like numerals represent like parts in the several views.

DESCRIPTION OF THE PREFERRED EMBODIMENTS

Figure 1:
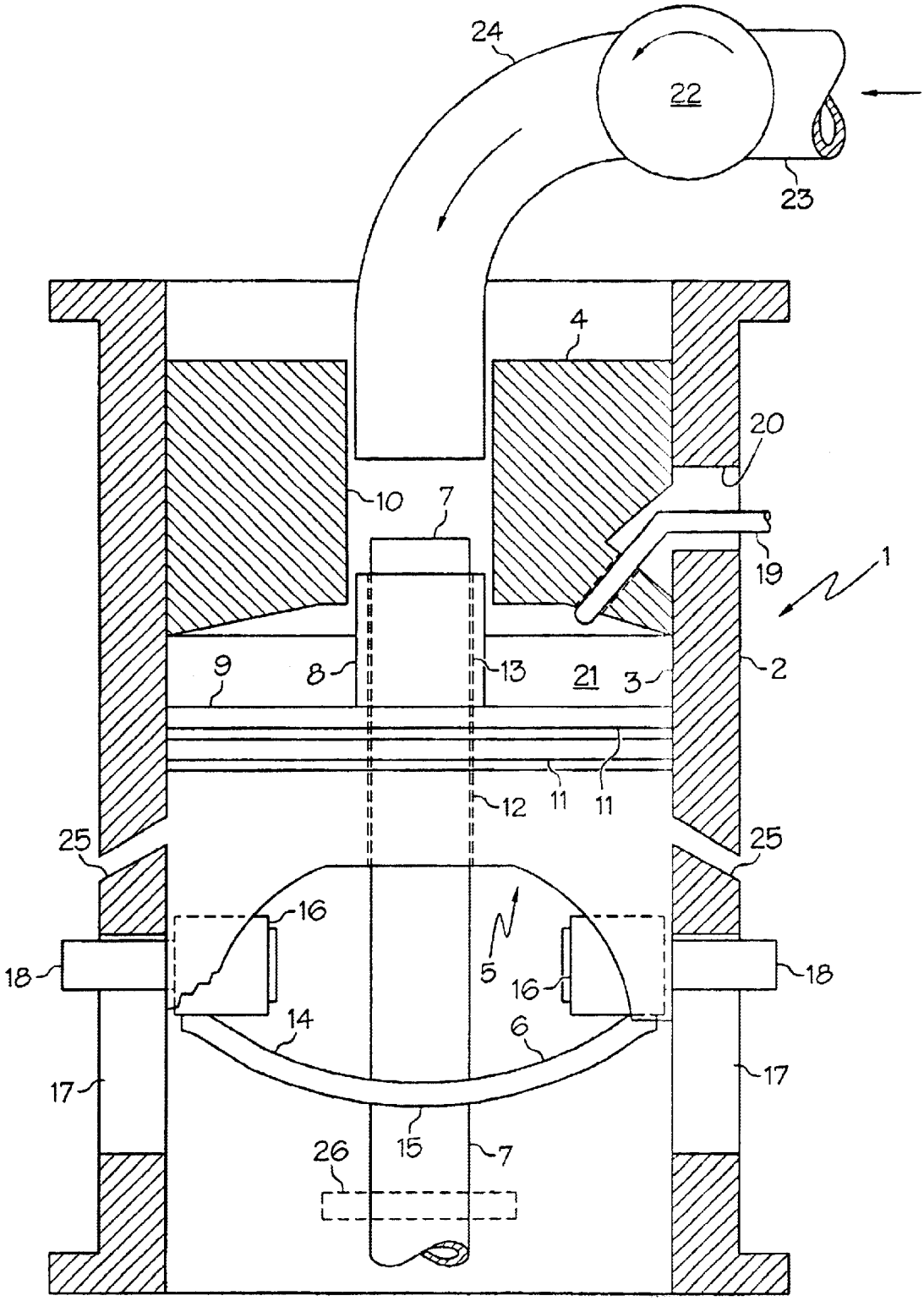
FIG. 1 represents, diagrammatically and not to scale, a longitudinal medial view, partially in section, of the diesel engine, showing the compound piston assembly at the top of its stroke.
Figure 2:
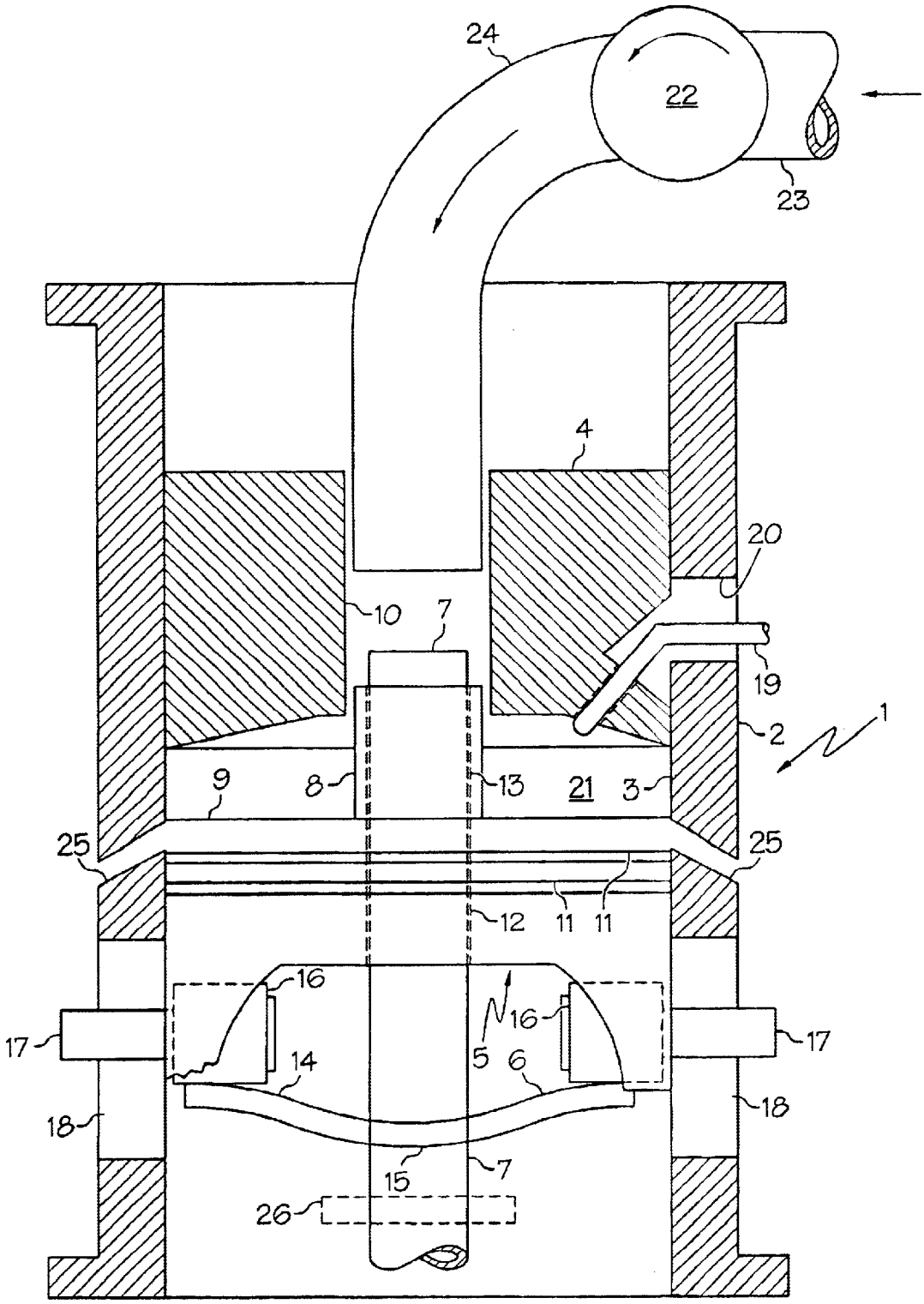
FIG. 2 represents, diagrammatically and not to scale, a longitudinal medial view, partially in section, of the diesel engine, similar to FIG. 1, showing the compound piston assembly in an intermediate position.
Figure 3:
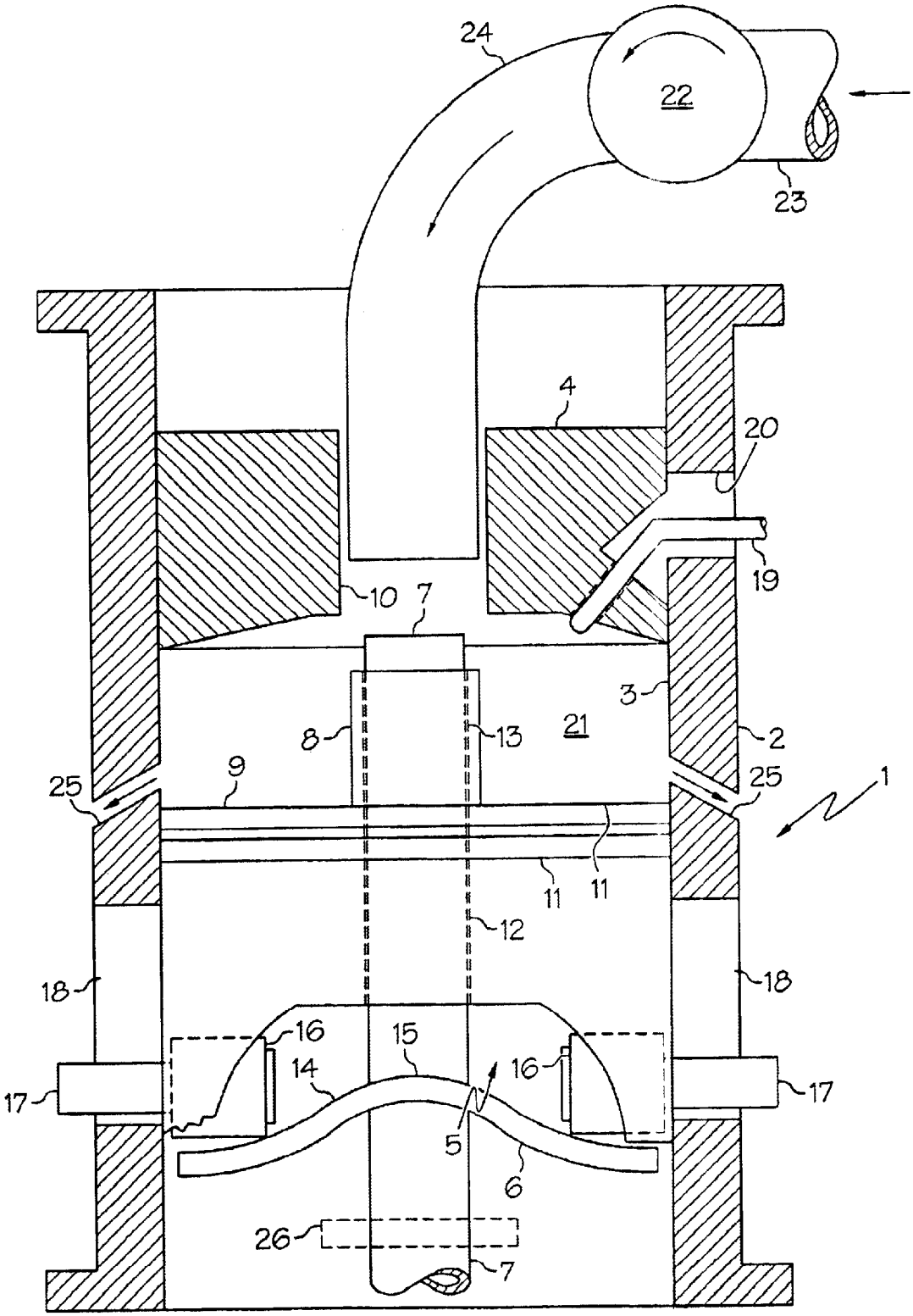
FIG. 3 represents, diagrammatically and not to scale, a longitudinal medial view, partially in section, of the diesel engine, similar to FIG. 1, showing the compound piston assembly at the bottom of its stroke.

FIGS. 1–3 show diesel engine 1 comprising hollow cylinder 2 having a central bore 3, a circular cylinder head 4 fixedly mounted within cylinder 2, circular compound piston assembly longitudinally movable within cylinder 2, and swash plate 6 secured to rotatable drive shaft 7.

Compound piston assembly 5 comprises a small diameter piston 8 and a hollow large diameter main piston 9, said pistons 8 and 9 being secured to each other.

Small diameter piston 8 slidably engages bore 10 in cylinder head 4.

Large diameter piston 9 slidably engages, through piston rings 11, central bore 3 in cylinder 2.

Rotatable drive shaft 7 extends through the bore 12 of large diameter main piston 9 and through central bore 13 in small diameter piston 8.

In the embodiment of FIGS. 1–3, swash plate 6, otherwise known as a wobble plate, is formed with a pair of gradual slopes 14 extending iii one direction away from the center of swash plate 6, and with a pair of gradual slopes 15 extending in the opposite direction away from the center of swash plate 6, the said gradual slopes 14 and 15 being arranged alternately in equispaced relation around the swash plate 6.

Swash plate 6 is positioned in cylinder 2 so that slopes 14 and 15 alternately engage roller bearings 16 rotatably mounted within the hollow of, and to, large diameter main piston 9. It will be seen that, as swash plate 6 rotates, or is caused to rotate, the alternate engagement of slopes 14 and 15 with roller bearings 16 coincides with the longitudinal movement of compound piston assembly 5 within cylinder 2.

In this preferred embodiment, swash plate 6 has two pair of gradual slopes 14 and two pair of gradual slopes 15 positioned alternately in equispaced relationship around the circumference of swash plate 6. In other words, slopes 14 and 15 are 90° apart. Slopes 14 on opposite edges of swash plate 6 must simultaneously engage roller bearings 16 which are positioned 180° apart on opposite sides of the hollow large diameter main piston 9. Similarly, slopes 15 on opposite edges of swash plate 6 must simultaneously engage the said roller bearings 16.

The embodiment shown herein may employ a swash plate 6 with additional equispaced pairs of slopes 14 and 15.

The distances between those surfaces of slopes 14 and 15 which engage roller bearings 16 is equal to the length of travel of compound piston assembly 5 within cylinder 2.

Compound piston assembly 5 is provided with stabilizing rods 17 projecting into slots 18 in cylinder 2, thus preventing compound piston assembly 5 from rotating within bore 3 of cylinder 2.

Diesel fuel injector 19 extends through aperture 20 in cylinder 2 and communicates with combustion chamber 21 between the upper surface of main piston 9 and the lower surface of cylinder head 4.

Blower 22 receives air through conduit 23 communicating with the inlet of blower 22.

Conduit 24 communicates at one end thereof with the outlet of the blower 22, and communicates at the other end thereof with bore 10 in cylinder head 4. That end of conduit 24 which extends into bore 10 fits the said bore 10. In other words, such end is circular and of substantially the same diameter as bore 10. Such end extends into bore 10 to a point short of small diameter piston 8 at the top of its stroke, thereby avoiding a collision in bore 10 between that end of conduit 24 extending into bore 10 and that end of small diameter piston 8 also extending into bore 10 and slidably engaging the interior thereof.

Conduit 24 can be made of two pieces, one a circular ring extending into bore 10 and secured therein, and the other an ordinary length of conduit secured to the circular ring at the top thereof and extending to and secured to the outlet of blower 22.

In operating the embodiment of FIGS. 1–3, with compound piston assembly 5 at the top of its stroke, air is passed through conduit 23 to the inlet of blower 22 and is blown out of the outlet of blower 22 through conduit 24 into bore 10 above the free end of small diameter piston 8.

Due to the rotation of drive shaft 7, resulting from a previous step in the combustion cycle of operation, or from the momentum of fly wheel 26 useful at least in starting up diesel engine 1, swash plate 6 rotates to remove the tops of slopes 14 or 15 away from engagement with roller hearings 16. At the same time, the pressure of the injected air in bore 10 against the top or free end of small diameter piston 8 forces the compound piston assembly 5 downwardly in central bore 3 of cylinder 2, thereby permitting the injected air to enter the combustion chamber 21. Diesel fuel is introduced into combustion chamber 21 through aperture 20 by means of diesel fuel injector 19 and mixes with the injected air.

The momentum of rotating drive shaft 7 and fly wheel 26, applied through swash plate 6 and roller bearings 16, forces compound piston assembly 5 upwardly in bore 3 to the top of its stroke. The dimensions of combustion chamber 21 relative to the volume of the mixture of diesel fuel and air in combustion chamber 21 and the volume of the combustion chamber 21 at the top of the stroke of compound piston assembly 5 are chosen so that the compression of the mixture of diesel fuel and air in the combustion chamber 21 at the top of the stroke of compound piston assembly 5 raises to the ignition point the temperature of the said mixture of diesel fuel and air. The exhaust gases so produced will generate pressure sufficient to bear against the upper surface of main piston 9 and thereby force compound piston assembly 5 downwardly to the bottom of its stroke, thus continuing the rotation of drive shaft 7. The exhaust gases pass out of diesel engine 1 through exhaust ports 25.

Figure 4:
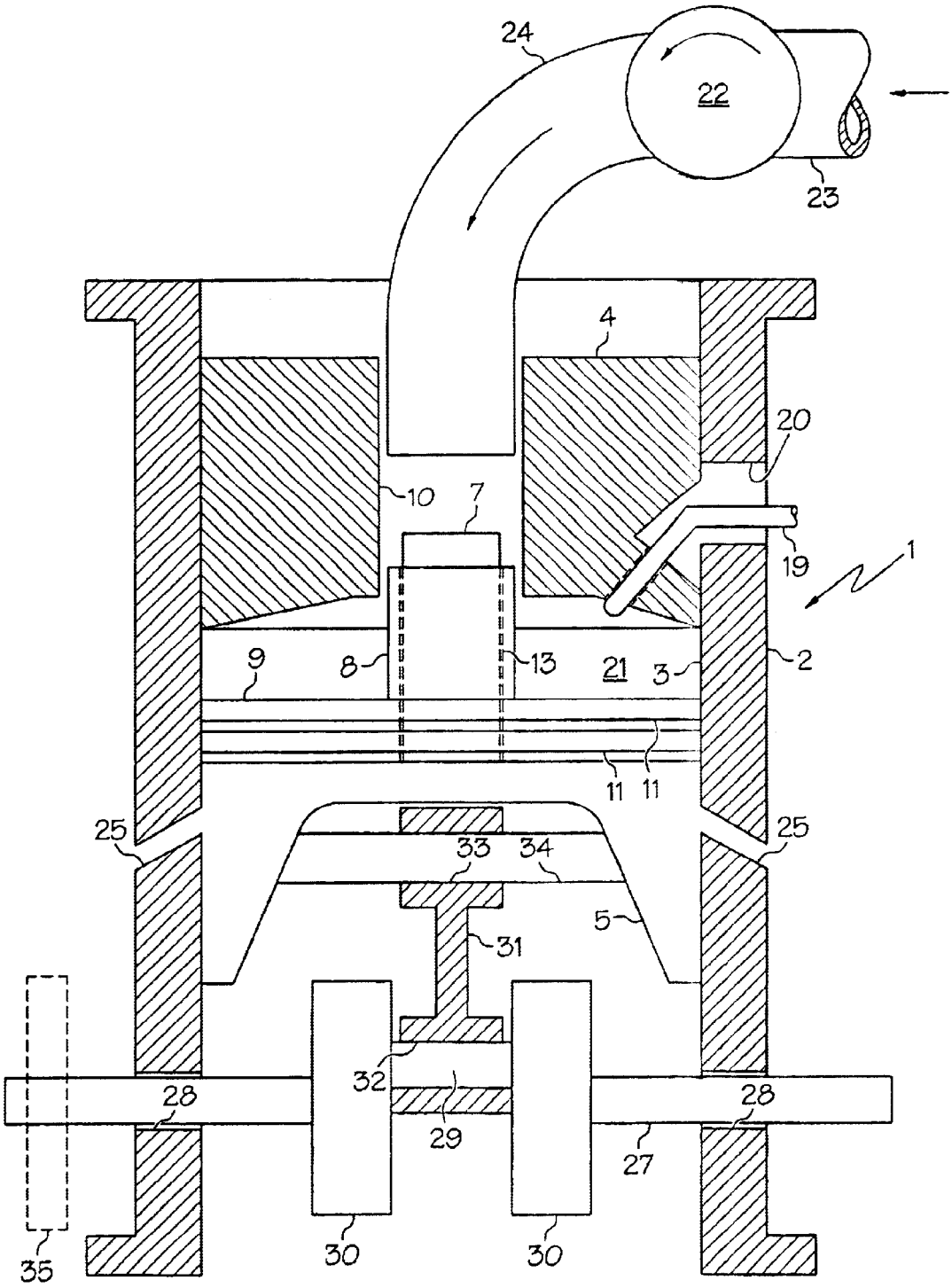
FIG. 4 represents, diagrammatically and not to scale, a longitudinal medial view, partially in section, of an alternate design of diesel engine, but otherwise similar to FIG. 1, showing another form of shaft rotating means operatively interposed between the compound piston assembly and the drive shaft, whereby longitudinal movement of the compound piston assembly causes the drive shaft to rotate.

The embodiment of FIG. 4 is operated in the same manner as the embodiment of FIGS. 1–3. However, different means are interposed between the compound piston assembly and the drive shaft 7 to rotate the said drive shaft.

Rotatable drive shaft 27 extends through apertures 28 in opposite sides of cylinder 2, and is provided with cam 29 bounded by side member 30. Crank 31 is provided at one end with aperture 32 receiving cam 29. The other end of crank 31 extends into the hollow of large diameter main piston 9 and is provided with aperture 33. Rod 34, mounted to, and within the hollow of, large diameter main piston 9, extends through aperture 33. Rotatable drive shaft 27 is provided with fly wheel 35.

Rotation of drive shaft 27 causes cam 29, which in turn acts on rod 34, to raise compound piston assembly 5 to the top of its stroke, and alternatively to permit compound piston assembly 5 to descend to the bottom of its stroke.

In other respects, the operation of diesel engine 1 shown in FIG. 4 is identical with the operation of diesel engine 1 shown in FIGS. 1–3.

Since modifications and changes which do not depart from the spirit of the invention as disclosed herein may readily occur to those skilled in the art to which this invention pertains, the appended claims should be construed as covering all suitable modifications and equivalents.

I claim:

1. A diesel engine comprising:

(a) a cylinder, (b) a first bore in said cylinder, (c) a cylinder head adjacent one end of said cylinder, (d) a second bore extending through said cylinder head, (e) means to introduce air into said second bore, (f) a compound piston assembly slidably mounted in said cylinder and movable between the bottom of its stroke and the top of its stroke, said compound piston assembly comprising:

(i) a first piston having a first end slidably extending into said second bore, (ii) a main piston larger in diameter than said first piston and slidably engaging said first bore, (g) a combustion chamber within said cylinder and defined by the upper face of said main piston and the lower portion of said cylinder head, (h) a diesel fuel injector communicating with said combustion chamber and adapted to deliver diesel fuel into said combustion chamber, (i) said air introduced into said second bore bearing against the first end of said first piston and forcing said compound piston assembly downwardly in said cylinder the bottom of its stroke, (j) whereby the exit of the first end of said first piston from said second bore permits air in said second bore to enter said combustion chamber, (k) the dimensions of said combustion chamber being selected so that when said compound piston assembly reaches the top of its stroke within said cylinder, the temperature of the air and diesel fuel within said combustion chamber reaches the ignition point, (l) whereby, upon ignition of said air and diesel fuel within said combustion chamber, said compound piston assembly is forced longitudinally in said cylinder toward the bottom of its stroke, (m) an exhaust port extending through the wall of said cylinder and permitting the escape from said combustion chamber of the products of combustion therein, (n) a drive shaft rotatably mounted to said cylinder, (o) shaft rotating means operatively interposed between said compound piston assembly and said drive shaft to rotate said drive shaft upon longitudinal movement of said compound piston assembly in said cylinder.

2. A diesel engine as in claim 1, wherein said shaft rotating means comprises:

(p) a swash plate secured to said drive shaft, (q) driving means connected to said compound piston assembly and engaging said swash plate.

3. A diesel engine as in claim 2, wherein said driving means comprises roller bearings rotatably mounted to said main piston and engaging said swash plate.

4. A diesel engine as in claim 1, wherein said drive shaft extends longitudinally through said compound piston assembly and said cylinder head.

5. A diesel engine as in claim 1, wherein said drive shaft extends transversely through said cylinder, said shaft rotating means comprising:

(p) a cam on said drive shaft, (q) a crank having a first aperture through one end thereof and a second aperture through the opposite end thereof, (r) a rod extending transversely through said cylinder and secured to said compound piston assembly, (s) said first aperture in said crank rotatably receiving said rod, (t) said second aperture in said crank rotatably receiving said cam.

* * * * *